US007004775B1

(12) United States Patent
Sakurai et al.

(10) Patent No.: US 7,004,775 B1
(45) Date of Patent: Feb. 28, 2006

(54) CONTACT MEMBER FOR FLAT WIRING MEMBER AND CONNECTOR HAVING THE SAME

(75) Inventors: Atsushi Sakurai, Shinagawa (JP); Manabu Shimizu, Shinagawa (JP); Koki Sato, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/095,576

(22) Filed: Apr. 1, 2005

(30) Foreign Application Priority Data

Aug. 19, 2004 (JP) ..... 2004-239760
Sep. 10, 2004 (JP) ..... 2004-264238

(51) Int. Cl.
*H01R 13/15* (2006.01)

(52) U.S. Cl. ..... 439/260; 439/495

(58) Field of Classification Search ..... 439/260, 439/263, 495, 857, 848, 108, 608, 565
See application file for complete search history.

(56) References Cited

U.S. PATENT DOCUMENTS 3,199,066 A * 8/1965 Eledge et al. ..... 439/857
3,412,369 A * 11/1968 Fox ..... 439/748
3,414,867 A * 12/1968 Travis ..... 439/417
3,694,791 A * 9/1972 Urban ..... 439/263
3,716,817 A * 2/1973 Wolfe et al. ..... 439/346
3,858,957 A * 1/1975 Harwood et al. ..... 439/59
4,669,795 A * 6/1987 Bonhomme ..... 439/267
4,695,111 A * 9/1987 Grabbe et al. ..... 439/266
5,240,430 A * 8/1993 Soes ..... 439/260
5,842,883 A * 12/1998 Igarashi et al. ..... 439/495
6,042,408 A * 3/2000 Noro ..... 439/260
6,056,572 A * 5/2000 Matsumoto et al. ..... 439/260
6,089,905 A * 7/2000 Shimmyo et al. ..... 439/495
6,099,346 A * 8/2000 Hashiguchi et al. ..... 439/495
6,280,217 B1 * 8/2001 Lin ..... 439/260
6,319,052 B1 * 11/2001 Chang ..... 439/495

FOREIGN PATENT DOCUMENTS

JP 6-21178 3/1994

* cited by examiner

*Primary Examiner*—Tulsidas C. Patel
*Assistant Examiner*—Vladimir Imas
(74) *Attorney, Agent, or Firm*—Staas & Halsey LLP

(57) ABSTRACT

First and second signal contact members and ground contact members are arranged in parallel in an electrical insulating block body. Each of the contact members has an FPC holding section. The FPC holding section comprises a first contact arm, a locking section projecting from a proximal end of the first contact arm in a Z2 direction, an L-shaped base arm, a narrow section, a second contact arm, and a push section extending from a proximal end of the second contact arm in a Z1 direction. When the push section is pushed by an end of an FPC, the narrow section is bent so that the second contact arm is moved closer to the first contact arm. The push section is locked by the locking section so that the FPC is held and fixed between the first contact arm and the second contact arm.

18 Claims, 17 Drawing Sheets

100
105
Y1
Y2
102b
103b
104b
101
Z1
Z2
101a
X1
X2
102a
104a
103a
105c
105d
105a
105b
103
102
104

W10 < W11 L1 : L2 = 1 : 1

CONTACT MEMBER FOR FLAT WIRING MEMBER AND CONNECTOR HAVING THE SAME

BACKGROUND OF THE INVENTION

1. Field of the Invention

The present invention relates to a contact member for a flat wiring member and a connector having the same.

The term "flat wiring member" as used herein includes Flexible Print Circuit (FPC), Flexible Flat Cable (FFC), printed wiring boards and the like.

2. Description of the Related Art

Data transmission is accomplished by two major methods. One is an imbalanced transmission method wherein a single wire is used for every data element. The other is a balanced transmission method wherein two wires in pairs are used for every data element to simultaneously transmit a positive signal and a negative signal, of which the magnitude is equal to the magnitude of the positive signal and of which the transmission direction is opposite to the transmission direction of the positive signal. The balanced transmission method has an advantage of being less affected by noise than the imbalanced transmission method, and therefore the balanced transmission is gaining widespread use.

Connectors are used for transmitting data elements between apparatuses. Especially, for balanced data transmissions, balanced transmission connectors having special configurations are used.

Some connectors have an FPC connected on the rear side of the connector main body. In the manufacturing process of this type of connector, it is desirable that the FPC is made so that it can be quickly connected to the rear side of the connector main body.

However, in connectors having a configuration as disclosed in Japanese Utility Model Application Publication No. 6-21178, plural terminals disposed at an end of an FPC are respectively soldered to corresponding contacts disposed on the rear side of a connector main body.

Such soldering work requires considerable time, and therefore increases the production cost of the connectors.

SUMMARY OF THE INVENTION

In view of the foregoing, an object of the present invention is to provide a contact member for a flat wiring member that can lower manufacturing cost of a connector, and a connector having the same.

Features and advantages of the present invention are set forth in the description that follows, and in part will become apparent from the description and the accompanying drawings, or may be learned by practice of the invention according to the teachings provided in the description.

According to an aspect of the present invention, a contact member for a flat wiring member is disclosed, which comprises a main section, a first contact arm extending from the main section, a second contact arm extending from the main section to face the first contact arm, a push section arranged to be pushed by a front end of the flat wiring member inserted between the first contact arm and the second contact arm, a locking section configured to lock the push section at a position to which the push section is pushed and displaced, and a third contact section extending from the main section in a direction opposite to the first and second contact arms, wherein when the push section is pushed by the front end of the flat wiring member inserted between the first contact arm and the second contact, either the first contact arm or the second contact arm is displaced to narrow a clearance between a first contact section at a front end of the first contact arm and a second contact section at a front end of the second contact section so that the flat wiring member is held between the first contact section and the second contact section, and the push section is locked by the locking section.

A connector having the above-described contact members arranged therein can be fixed and connected to a flat wiring member only by inserting the flat wiring member to the connector. Therefore, a connector with a flat wiring member attached thereto can be produced without a time-consuming soldering work.

DETAILED DESCRIPTION OF THE PREFERRED EMBODIMENT

In the following, an embodiment of the present invention is described with reference to the accompanying drawings.

FIGS. 1 through 3B show a balanced transmission connector device 10 according to an embodiment of the present invention. The balanced transmission connector device 10, which uses a Flexible Printed Circuit (FPC) as an electric wire, is designed to electrically connect an FPC 11 to a Printed Circuit Board (PCB) 12.

The balanced transmission connector device 10 includes an FPC-side connector 20 connected to an end of the FPC 11 and a PCB-side connector 100 mounted on the PCB 12. The FPC-side connector 20 is configured to be inserted into the PCB-side connector 100. The FPC-side connector 20 is a jack type, while the PCB-side connector 100 is a plug type. The connector 20 with the FPC 11 attached to the end thereof is also referred to as an FPC-attached connector 20A.

Figure 1:
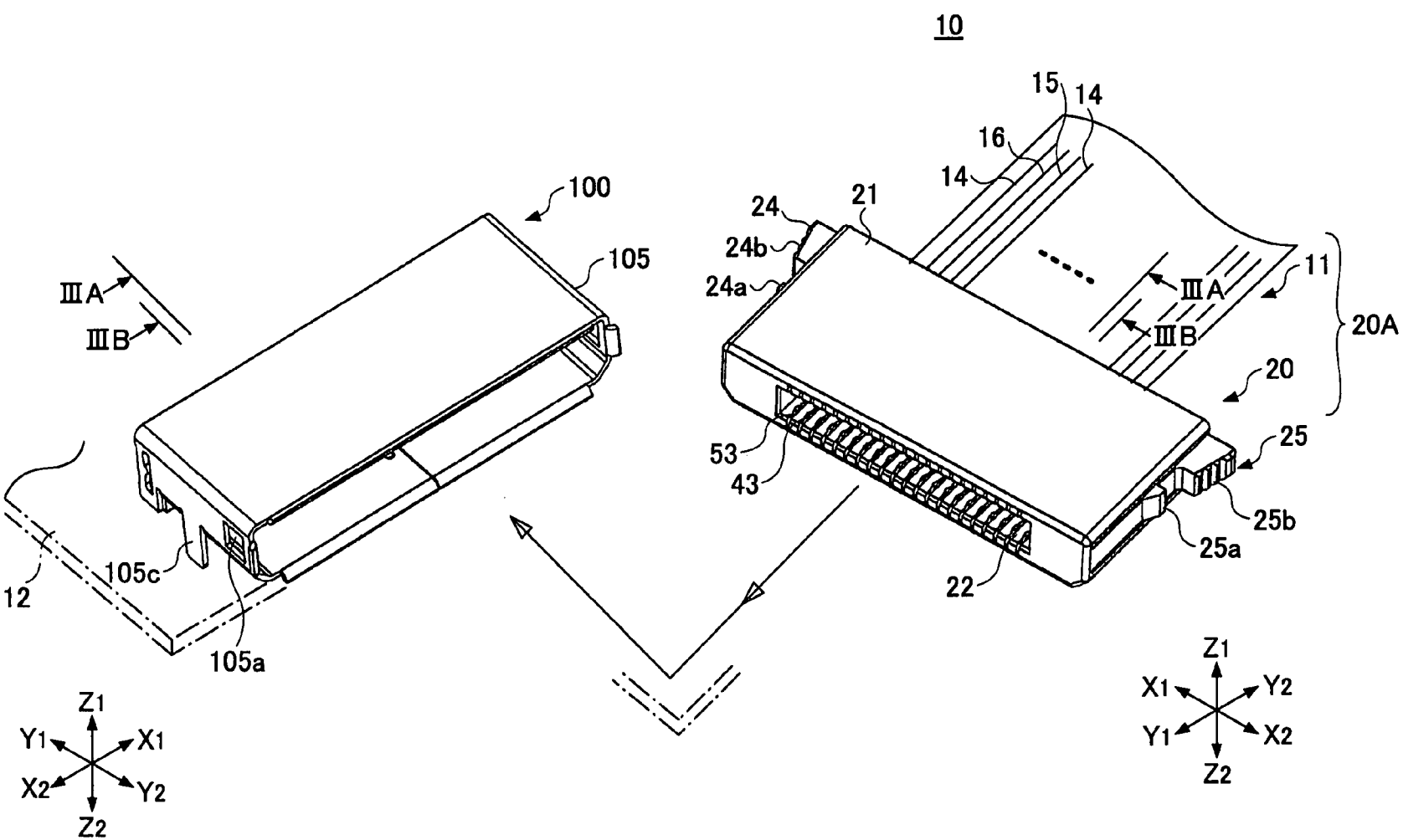
FIG. 1 is a front perspective view of an FPC-side connector and a PCB-side connector facing each other according to an embodiment of the present invention.
Figure 2:
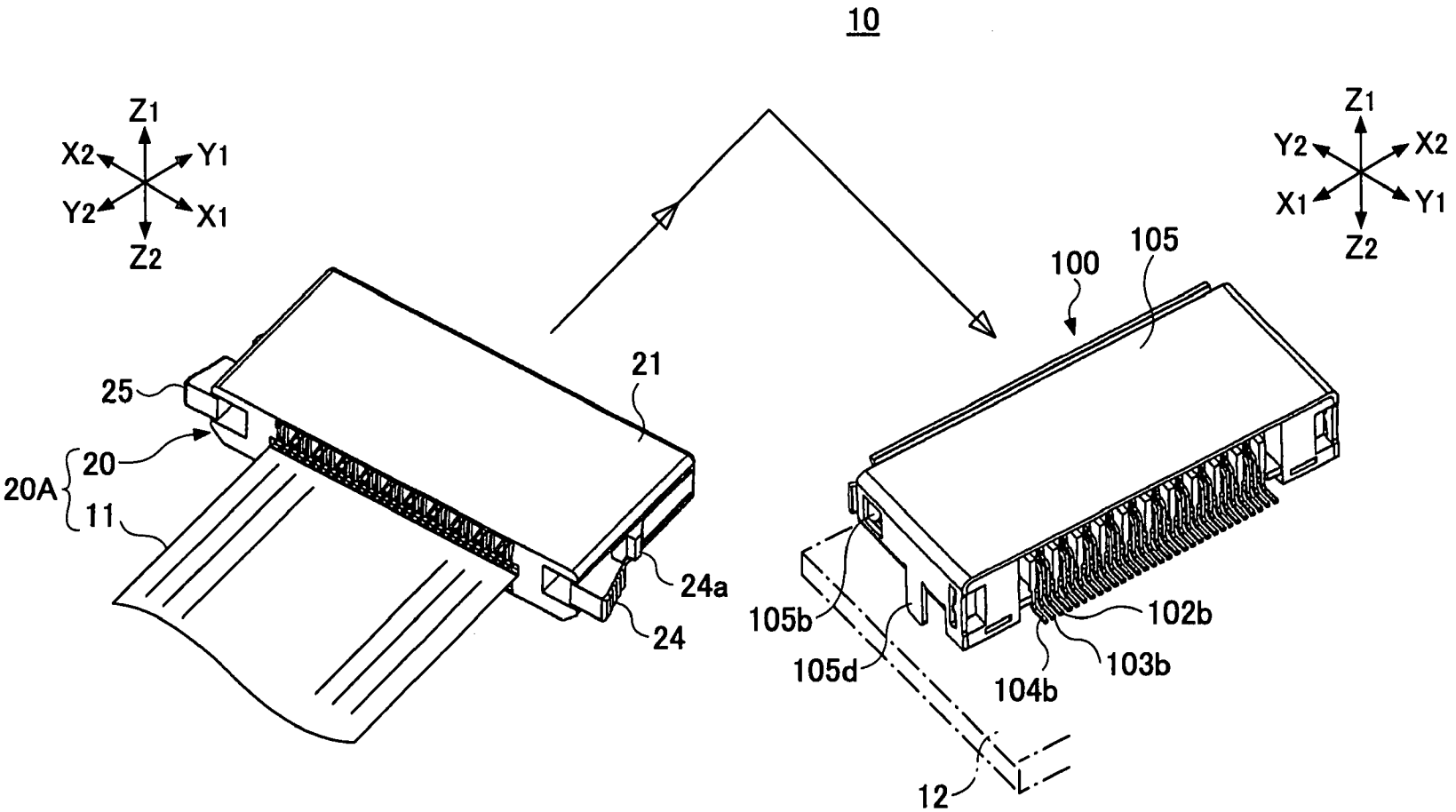
FIG. 2 is a rear perspective view of the FPC-side connector and the PCB-side connector facing each other.
Figure 3A:
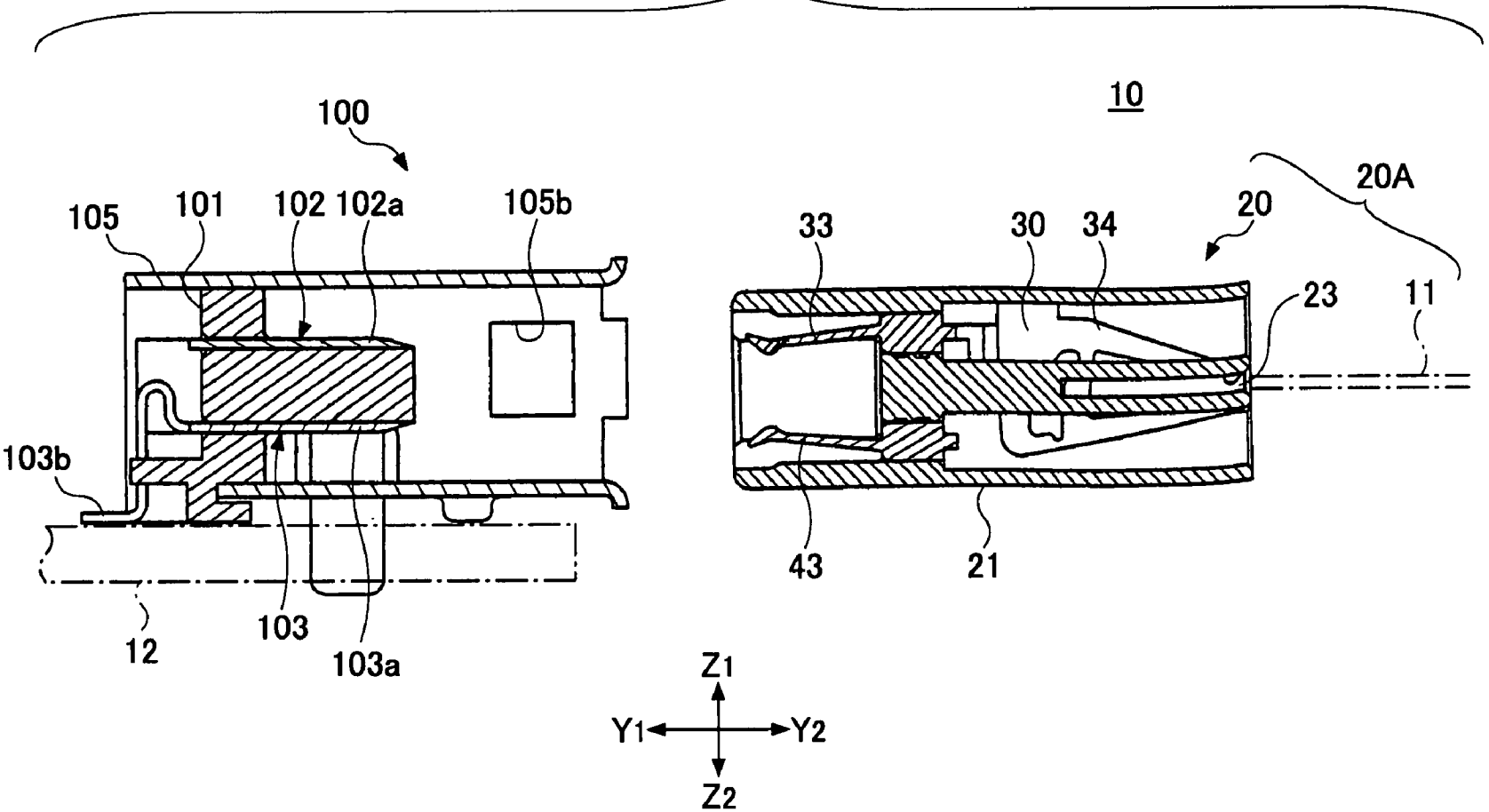
FIGS. 3A and 3B are cross-sectional views each showing the FPC-side connector and the PCB-side connector facing each other.
Figure 3B:
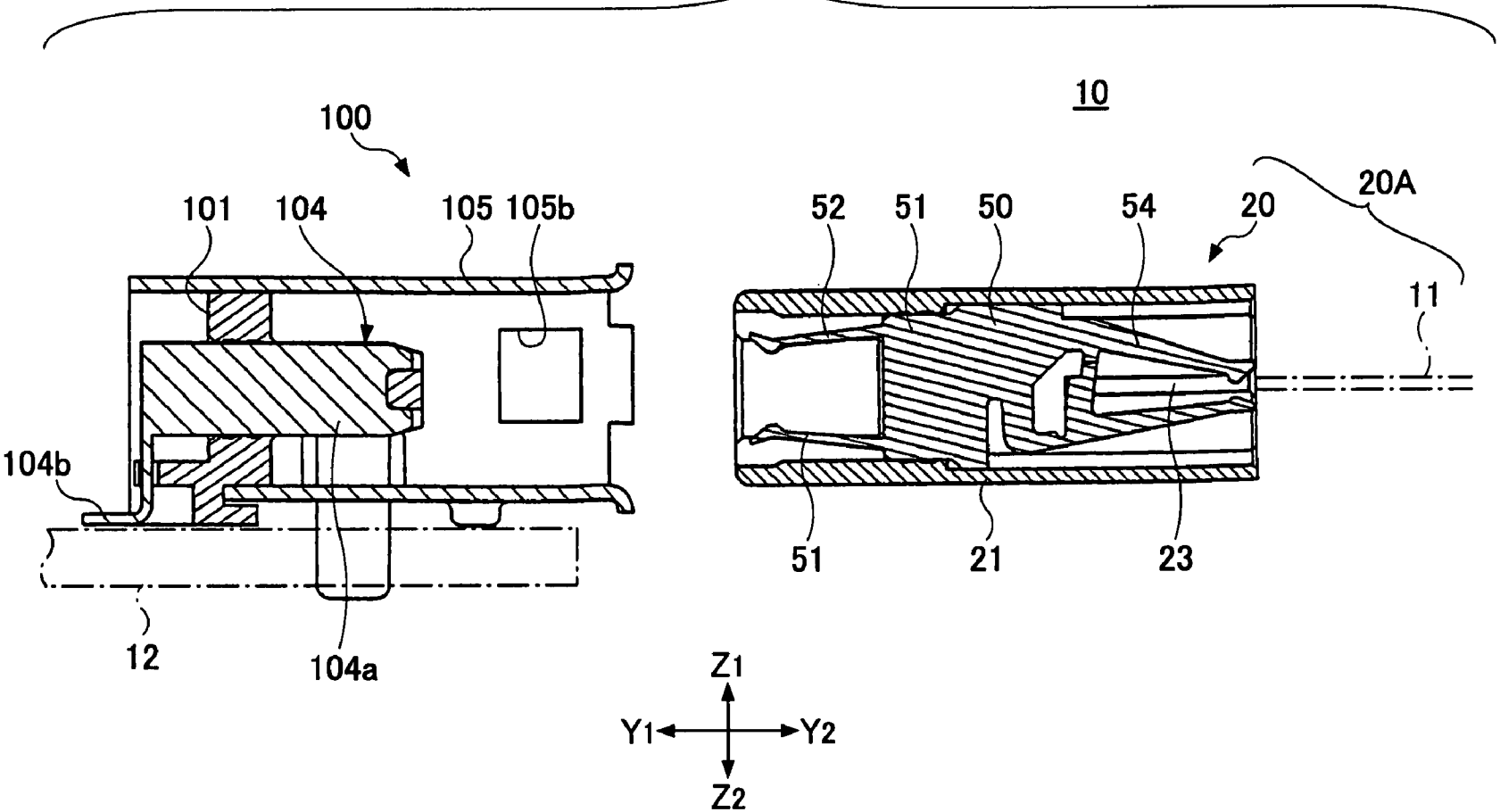

FIG. 1 shows a front perspective view of the FPC-side connector 20 (FPC-attached connector 20A) and the PCB-side connector 100 facing each other. FIG. 2 shows a rear perspective view of the FPC-side connector 20 and the PCB-side connector 100 facing each other. FIG. 3A shows a cross sectional view of the FPC-side connector 20 and the PCB-side connector 100 taken along a line IIIA—IIIA along a signal contact member. FIG. 3B shows a cross sectional view of the FPC-side connector 20 and the PCB-side connector 100 taken along a line IIIB—IIIB along a ground contact member. Throughout the drawings, X1–X2 indicates a direction in which contacts are arranged (direction of the connector width); Y1–Y2 indicates a direction of the contact length (direction of the connector depth/direction in which the connector is inserted); and Z1–Z2 indicates a direction of the connector height.

First, the PCB-side connector 100 is described in detail.

Figure 4:
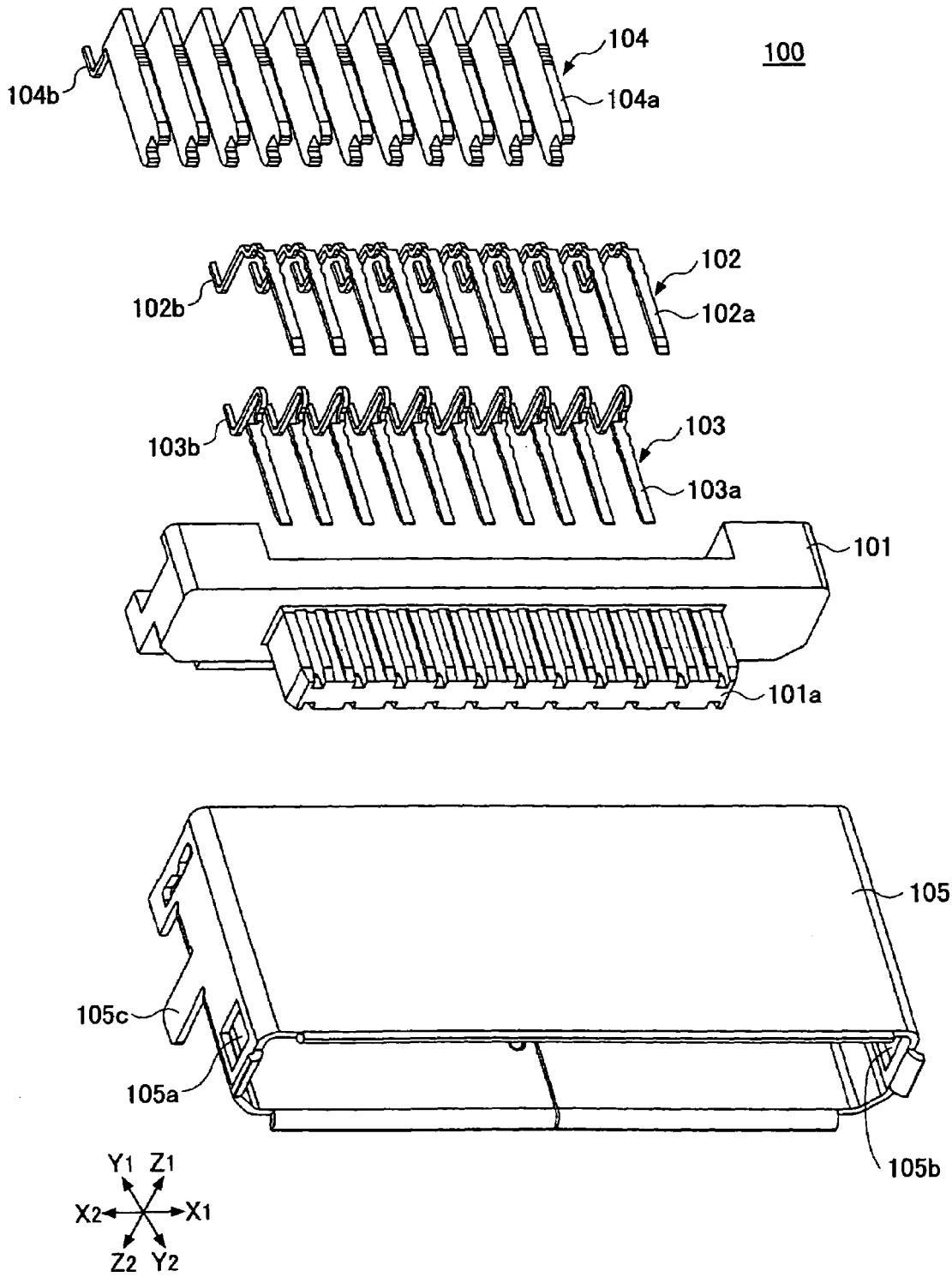
FIG. 4 is an exploded perspective view of the PCB-side connector.
Figures 5A, 5B, 5C, 5D, 5E, 5F:
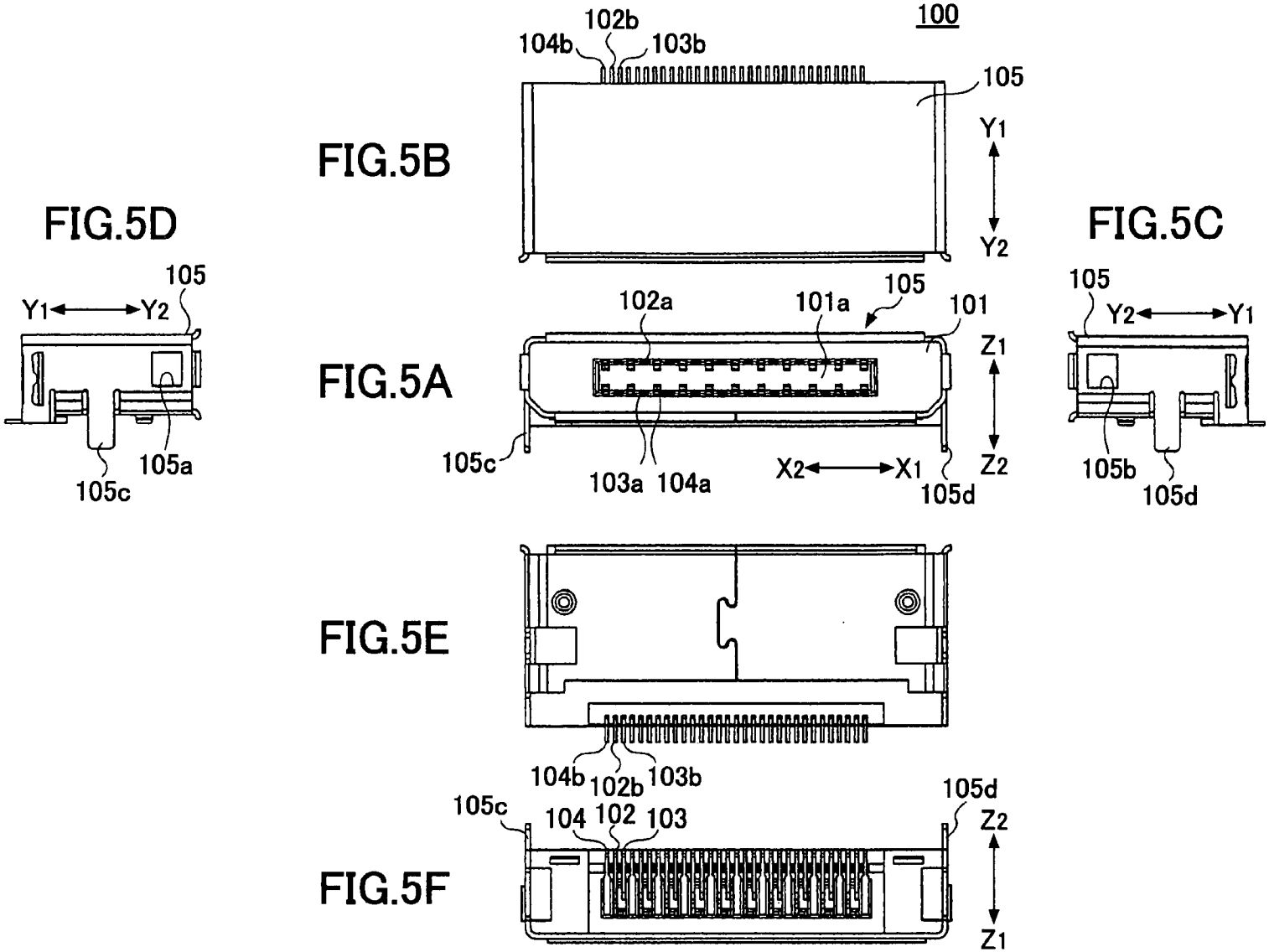
FIGS. 5A through 5F are orthogonal projection views of the PCB-side connector.

FIG. 4 is an exploded view of the PCB-side connector 100, and FIGS. 5A through 5F are orthogonal projection views of the PCB-side connector 100. Specifically, FIG. 5A is a front view; FIG. 5B is a top view; FIG. 5C is a right side view; FIG. 5D is a left side view; FIG. 5E is a bottom view; and FIG. 5F is a rear view.

The PCB-side connector 100 comprises an electrical insulating block body 101, plural pairs of first and second signal contact members 102 and 103, and ground contact members 104, and a shield cover 105 enclosing the above elements 101 through 104. The contact members 102 through 104 are arranged in the block body 101. More specifically, in an elongated rectangular-solid extending section 101*a* extending to the Y2-side of the block body 101, a first signal contact section 102*a* of each first signal contact member 102 is paired with a second signal contact section 103*a* of each second signal contact member 103 in the vertical direction (i.e., column direction, Z1–Z2 direction). The pairs of signal contact sections 102*a* and 103*a* and the ground contact sections 104*a* are alternately arranged in the horizontal direction (i.e., row direction, X1–X2 direction). The shield cover 105 has locking holes 105*a* and 105*b* and attaching legs 105*c* and 105*d*.

Angular contact sections 102*b*, 103*b* and 104*b* on the Y1-side of the first and second signal contact members 102 and 103 and the ground contact members 104 are soldered to corresponding pads on the PCB 12. The attaching legs 105*c* and 105*d* are fitted into holes of the PCB 12 and soldered to the PCB 12. As such, the PCB-side connector 100 is mounted on the PCB 12.

Next, the FPC-side connector 20 is described in detail.

Figure 6:
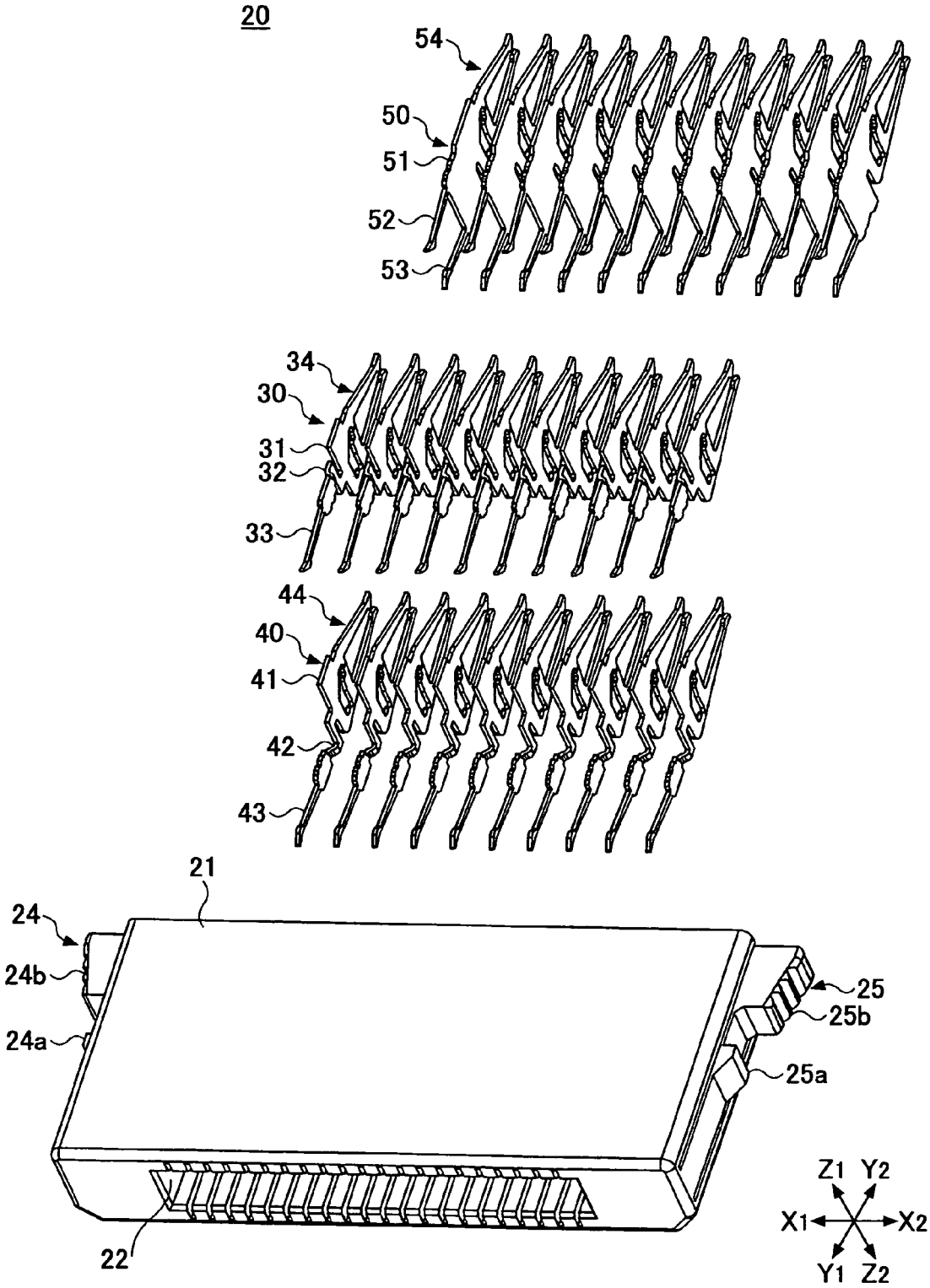
FIG. 6 is an exploded perspective view of the FPC-side connector according to an embodiment of the present invention.
Figure 7B:
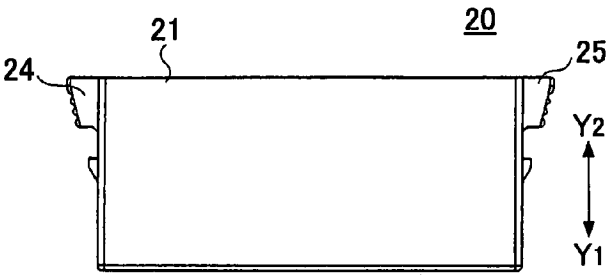
FIGS. 7A through 7F are orthogonal projection views of the FPC-side connector according to an embodiment of the present invention.
Figure 7A:
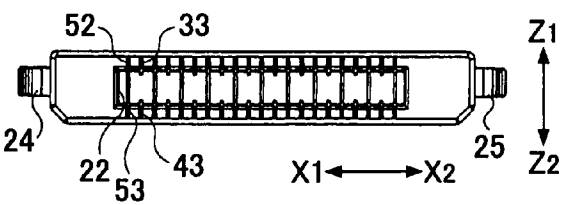
Figure 7E:
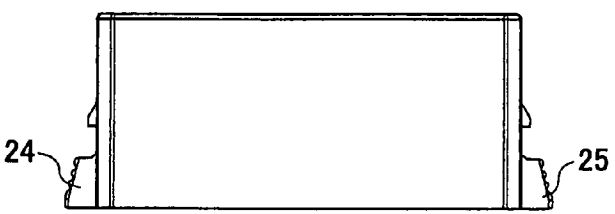
Figure 7F:
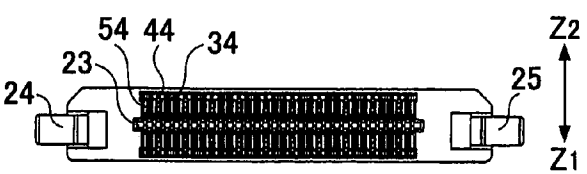
Figure 7D:
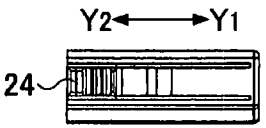
Figure 7C:
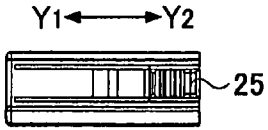

FIG. 6 is an exploded view of the FPC-side connector 20, and FIGS. 7A through 7F are orthogonal projection views of the FPC-side connector 20. Specifically, FIG. 7A is a front view; FIG. 7B is a top view; FIG. 7C is a right side view; FIG. 7D is a left side view; FIG. 7E is a bottom view; and FIG. 7F is a rear view.

The FPC-side connector 20 comprises an electrical insulating block body 21, plural pairs of first and second signal contact members 30 and 40, and plural ground contact members 50. The pairs of the first and second signal contact members 30 and 40 and the ground contact members are alternately arranged in the horizontal direction (i.e., row direction, X1–X2 direction) in the block body 21.

The block body 21 has a connection opening 22 sized to correspond to the extending section 101*a* on the Y1-side (front side), an FPC insertion slot 23 on the Y2-side (rear side), and flexible locks 24 and 25, one on each of the side faces in the X1–X2 direction. The FPC insertion slot 23 has an elongated shape corresponding to the shape of the end of the FPC 11, the FPC 11 having a reinforcing board 17 (to be discussed below) attached thereto. The FPC insertion slot 23 is partitioned into a number of sections by the first and second signal contact members 30 and 40 and the ground contact members 50. The locks 24 and 25 have detent sections 24*a* and 25*a* and control sections 24*b* and 25*b*.

Referring to FIG. 6, the signal contact members 30 and 40 and the ground contact members 50 are formed by pressing metal plates. Each of the first signal contact members 30 has a plate-like main section 31, a cross portion 32, a first signal contact section 33 displaced in the X2 direction by the cross section 32 and having the Z1-side thereof extending in the Y1 direction, and an FPC holding section 34 extending from the main section 31 in the Y2 direction. Each of the second signal contact members 40 has a plate-like main section 41, a cross portion 42, a second signal contact section 43 displaced in the X1 direction by the cross portion 42 and having the Z2-side thereof extending in the Y1 direction, and an FPC holding section 44 extending from the main section 41 in the Y2 direction. Each of the ground contact members 50 has a plate-like main section 51, a Z1-side ground contact section 52 and a Z2-side ground contact section 53 extending from the main section 51 in the Y1 direction, and an FPC holding section 54 extending from the main section 51 in the Y2 direction.

The first signal contact sections 33 and ground contact sections 52 are fitted in grooves on an inner upper face of the connection opening 22, and the second signal contact sections 43 and ground contact sections 53 are fitted in grooves on an inner lower face of the connection opening 22. In the connection opening 22, each first signal contact section 33 is paired with each second signal contact section 43 in the vertical direction (i.e., column direction, Z1–Z2 direction). The pairs of first and second signal contact sections 33 and 43 and the ground contact sections 52 and 53 are alternately arranged in the horizontal direction (i.e., row direction, X1–X2 direction).

The FPC holding sections 34 of the first signal contact members 30, the FPC holding sections 44 of the second signal contact members 40 and the FPC holding sections 54 of the ground contact members 50 are alternately arranged in this order at the rear side (Y2-side) of the block body 21 in the horizontal direction (i.e., row direction, X1–X2 direction).

Figure 8:
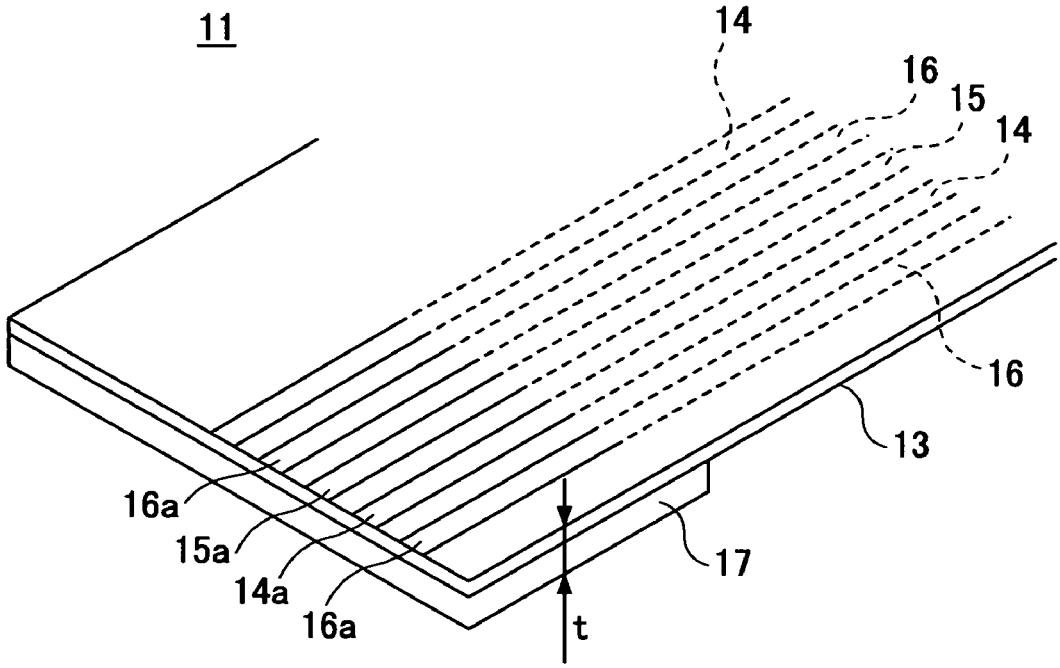
FIG. 8 is a perspective view showing an end of an FPC.

FIG. 8 shows the FPC 11. The FPC 11 has a sheet 13, first and second signal patterns 14 and 15 and ground patterns 16 provided on the sheet 13, first and second signal terminals 14*a* and 15*a* and ground terminals 16*a* exposed on an end of the sheet 13, and the reinforcing board 17 bonded to a lower face of the sheet 13. The total thickness of the FPC and the reinforcing board 17 is "t".

The following describes the shape and configuration of the FPC holding section 34.

Figure 9:
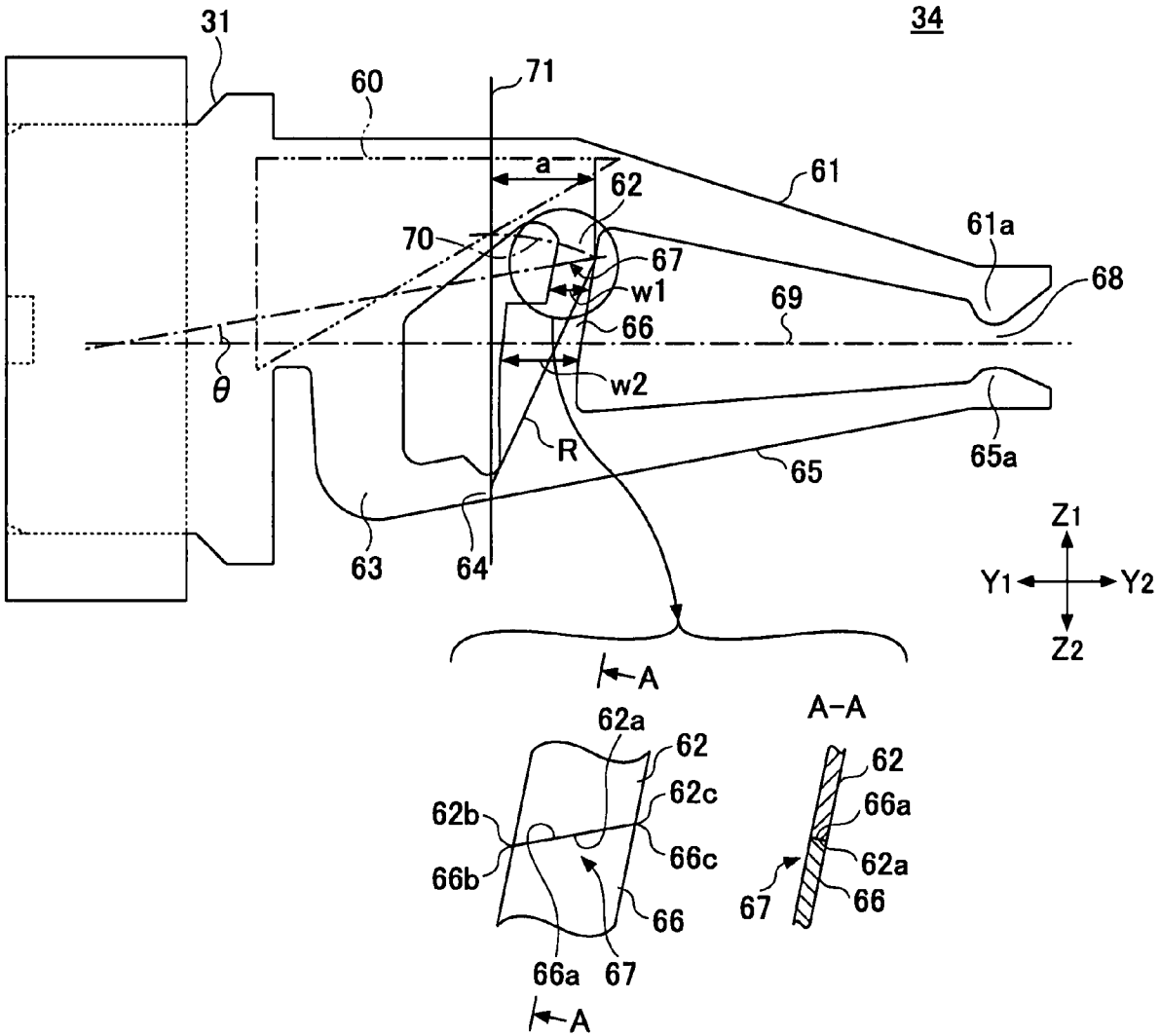
FIG. 9 is an enlarged view of a holding section of a first signal contact member.

Referring to FIG. 9, the FPC holding section 34 comprises a triangular section 60 extending in the Y2 direction from the upper half of the main section 31 and having a substantially triangular shape (indicated by chain double-dashed line) with a hypotenuse extending obliquely upward from the Z2 direction to the Z1 direction, a first contact arm 61 extending obliquely downward in the Y2 direction from a Z1-side front end of the triangular section 60, a locking section 62 projecting from a proximal end of the first contact arm 61 in the Z2 direction, an L-shaped base arm 63 extending from the Y1-side of the hypotenuse of the triangular section 60 first in the Z2 direction and then in the Y2 direction, a flexible narrow section (arm extension) 64 at the front end of the base arm 63, a second contact arm 65 extending obliquely upward in the Y2 direction from the narrow section 64, and a push section 66 extending from a proximal end of the second contact arm 65 toward the locking section 62 in the Z1 direction. The push section 66 and the locking section 62 are formed by cutting and dividing a continuous part at a cut 67 with a pressing method described below. A Z1-side cut end face 66*a* of the push section 66 abuts tightly a Z2-side cut end face 62*a* of the locking section 62. The pressing method used herein is a method to cut a continuous part at a cut so that formed cut surfaces tightly abut each other. For example, as shown in FIGS. 19A through 19D, an upper pattern 200 is lowered relative to a lower pattern 201 to a half of the thickness of a metal plate 210 to cut the metal plate 210. A section 211 of the metal plate 210 pushed downward by the upper pattern 200 is returned to its initial position so that cut surfaces of the section 211 and 212 tightly abut each other.

Figure 10:
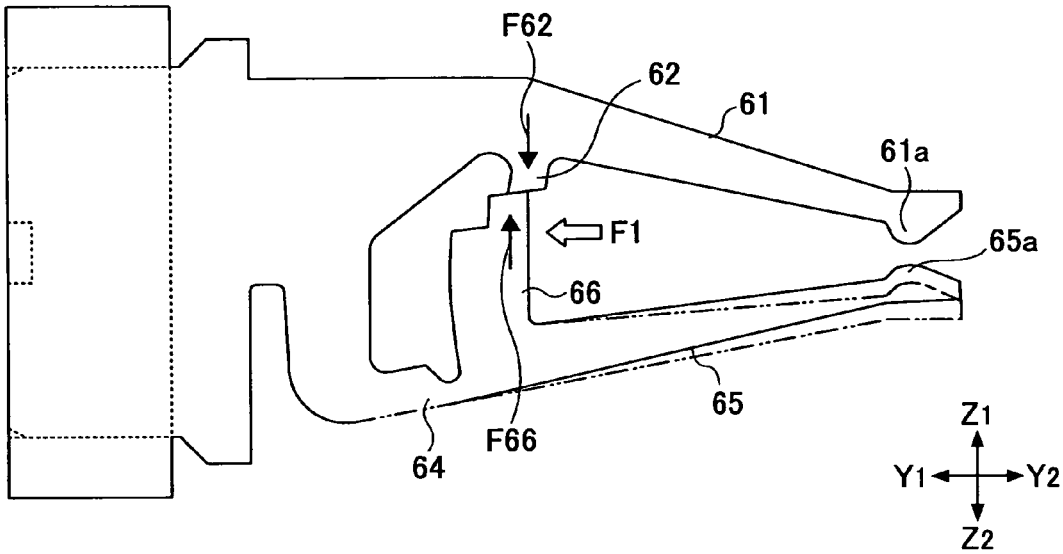
FIG. 10 shows a push section being pushed in the Y2 direction in a process of displacement.
Figure 11:
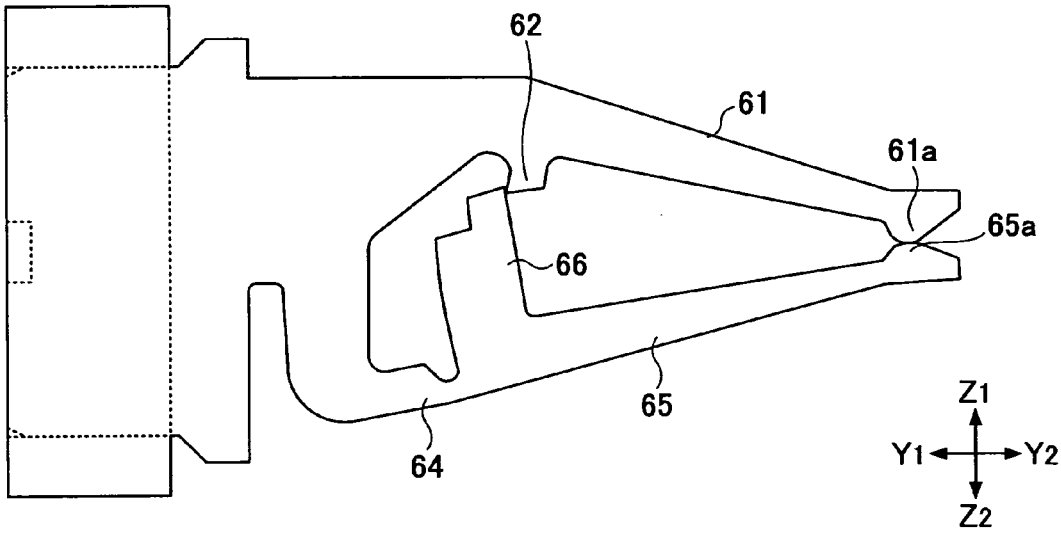
FIG. 11 shows a push section displaced to a final position and locked by a locking section.

Since the flexible narrow section 64 is provided at a Y1-side proximal end of the push section 66, the end face 66*a* of the push section 66 is moved in the Y1 direction relative to the end face 62*a* when the push section 66 is pushed with a force F1 (FIG. 10) in the Y1 direction. The narrow section 64 is deformed as shown in FIG. 10, so that the push section 66 and the second contact arm 65 are rotated about the narrow section 64 in the counterclockwise direction. Then, as shown in FIG. 11, the push section 66 is locked by the locking section 62. Once locked by the locking section 62, the push section 66 stays at the position shown in FIG. 11.

Since the triangular section 60, the base arm 63, the locking section 62 and the push section 66 of the FPC holding section 34 are fitted in a slit formed in the block body 21, their movements in the direction of the board thickness are restricted by walls on both sides of the slit. Therefore, the push section 66 is stably displaced while pushing the locking section 62, and then stays in a position locked by the locking section 62 stably.

When the second contact arm 65 is rotated about the narrow section 64 in the counterclockwise direction, a second contact section 65*a* at the front end of the second contact arm 65 is moved closer to a first contact section 61*a* at the front end of the first contact arm 61 so as to narrow a clearance 68 (FIG. 9) therebetween. As shown in FIG. 11, when the push section 66 is locked by the locking section 62, the second contact section 65*a* abuts the first contact section 61*a*. In this state, there is no clearance 68.

Referring back to FIG. 9, the locking section 62 and the push section 66 have a width W1 in the Y1–Y2 direction at the cut 67. The cut 67 is inclined at an angle θ relative to a center line 69 extending in the Y1–Y2 direction through a center of the clearance 68. A Y1-side corner 62*b* of the end face 62*a* of the locking section 62 is located lower than the Y2-side corner 62*c* thereof. A Y2-side corner 66*c* of the end face 66*a* of the push section 66 is located upper than the Y1-side corner 66*b* thereof. The push section 66 has a width W2 wider than the width W1 and is rigid enough to prevent it from being bent by a force applied in the Y1 direction.

The push section 66 is arranged to cross the center line 69. The cut 67 is located at the Z1-side of the center line 69.

The reference number 70 indicates an arc having its center on the narrow section 64 and a radius R from the center to the Y2-side corner 66*c* of the push section 66. The Y2-side corner 66*c* of the push section 66 is located at the Y2-side of a line 71 passing through the narrow section 64 in the Z1–Z2 direction, having a distance "a" therebetween. Accordingly, while the Y2-side corner 66*c* of the push section 66 is moved to the Y1 direction, the Y2-side corner 66*c* is moved also to the Z1 direction. With this motion, the locking section 62 is pushed upward to the Z1 direction while generating a restoring force F62 in the Z2 direction, and the push section 66 is pushed downward to the Z2 direction while generating a restoring force F66 in the Z1 direction. When the push section 66 is moved over the locking section 62 in the Y2 direction, the locking section 62 is moved in the Z2 direction with the resorting force F62. At the same time, the push section 66 is moved in the Z1 direction with the resorting force F66. The push section 66 is thus securely locked by the locking section 62.

The FPC holding section 44 of the second signal contact member 40 and the FPC holding section 54 of the ground contact member 50 have the same configuration as the above-described FPC holding section 34 of the first signal contact member 30.

The following describes how the end of the FPC 11 is connected and fixed to the rear side of the block body 21 without being soldered.

As shown in FIG. 7F, the FPC holding sections 34, 44 and 54 are arranged in the FPC insertion slot 23 at the rear side of the block body 21.

Figure 12A:
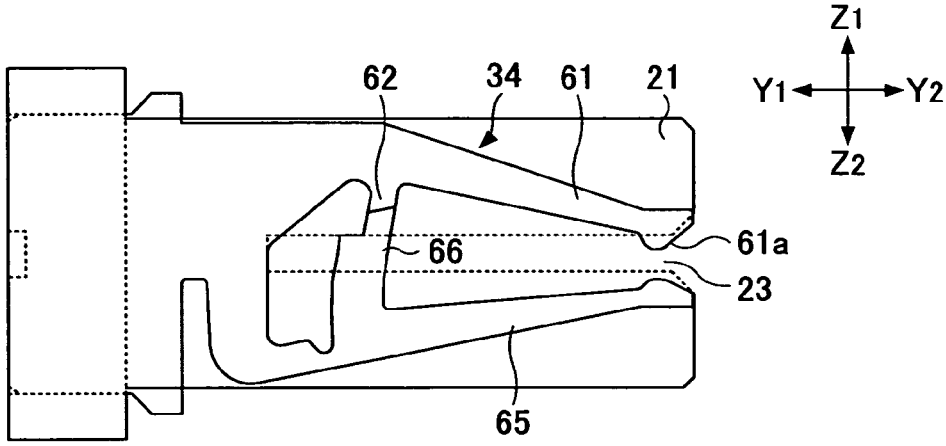
FIGS. 12A through 12C and FIGS. 13A through 13C are illustrations showing a process of inserting the FPC into the FPC-side connector and connecting the FPC to the FPC-side connector.
Figure 13A:
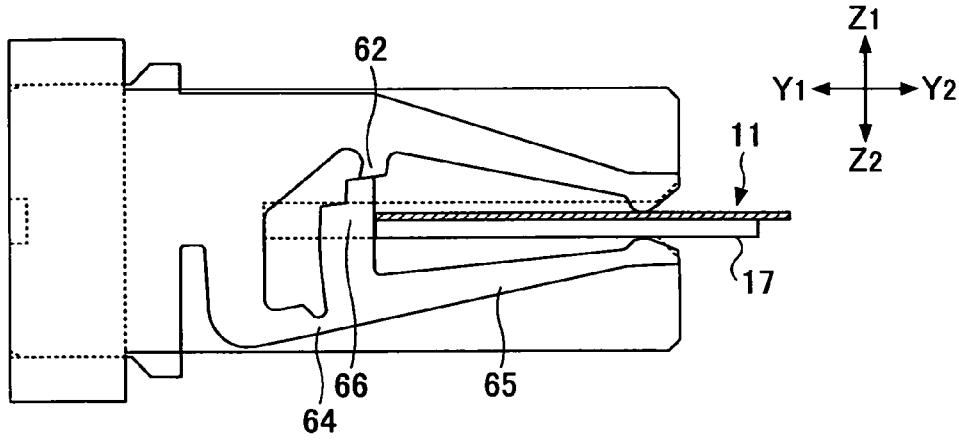

FIG. 12A is a side view from the X2-side, showing the relationship between the FPC insertion slot 23 and the FPC holding sections 34 (44, 54). The first contact section 61*a* at the front end of the first contact arm 61 projects inside the FPC insertion slot 23 from the Z1-side. The first contact section 61*a* can therefore receive the FPC 11 and a Z1 direction force of the second contact section 65*a* at the front end of the second contact arm 65, when the second contact section 65*a* is moved from the Z2-side to the Z1-side as shown in FIG. 13A, which is described later in detail.

When the end of the FPC 11 is strongly inserted into the FPC insertion slot 23 with use of a tool (if necessary), the FPC holding section 34 is deformed as shown in FIGS. 12B through 13B. When the FPC 11 reaches a position shown in FIG. 13C, the end of the FPC 11 is electrically connected to all the contact members 30, 40 and 50. At the same time, the end of the FPC 11 is held by the contact members 30, 40 and 50 with the elastic forces thereof and thus fixed without being soldered.

Figure 12B:
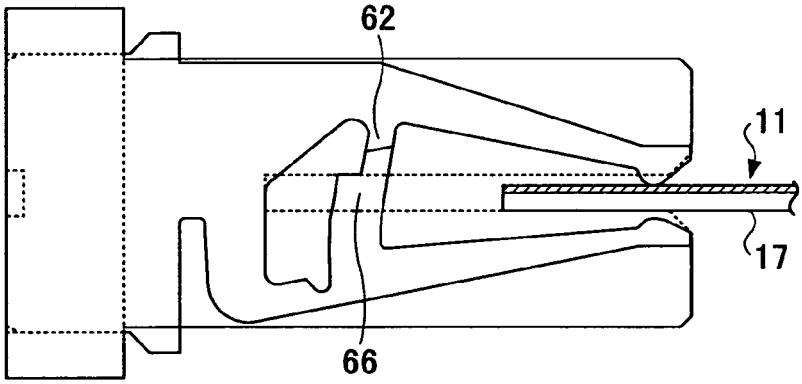
Figure 12C:
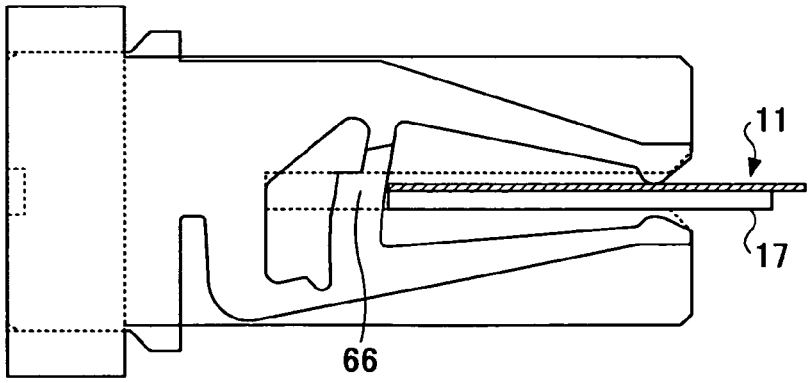

The above operations are explained below step by step. As shown in FIG. 12B, the end of the FPC 11 with the reinforcing board 17 attached thereon is inserted into the FPC insertion slot 23 passing under the first contact section 61*a*. As shown in FIG. 12C, the front end of the FPC 11 reaches the push section 66.

When the FPC 11 is further inserted, the push section 66 is pushed by the FPC 11. As shown in FIG. 13A, the narrow section 64 is deformed, so that the push section 66 and the second contact arm 65 are rotated about the narrow section 64 in the counterclockwise direction. Then, with reference to FIG. 13B, the second contact section 65*a* extends inside the FPC insertion slot 23 from the Z2-side, and thus the FPC 11 is held between the first contact section 61*a* and the second contact section 65*a*.

When the push section 66 and the second contact arm 65 are further rotated, the push section 66 is moved over the locking section 62. The push section 66 and the locking section 62 are respectively moved back to the Z1 direction and the Z2 direction with the respective restoring forces thereof, so that the push section 66 is locked by the locking section 62 as shown in FIG. 13C. Once locked by the locking section 62, the push section 66 stays at the position shown in FIG. 13C.

Figure 13B:
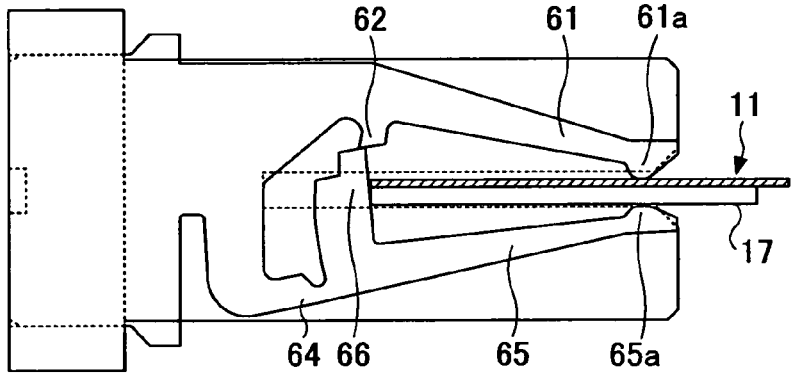
Figure 13C:
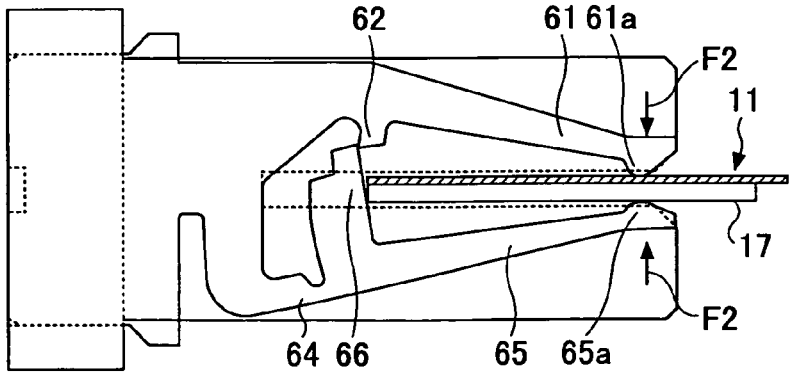
Figure 14:
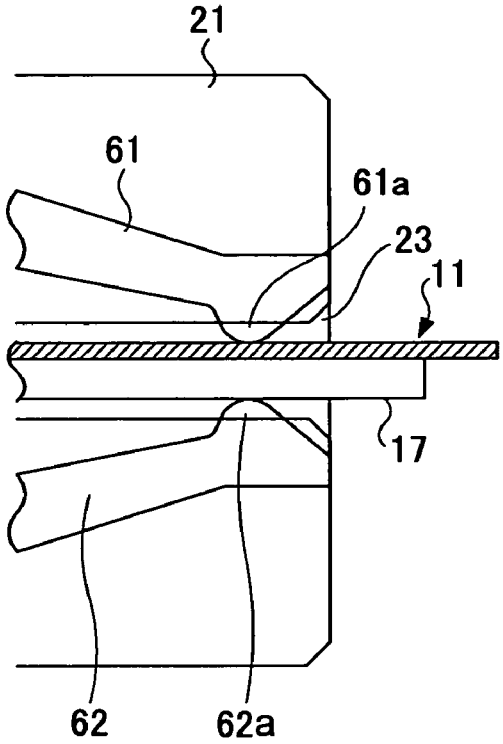
FIG. 14 is an enlarged view of the FPC connected to the FPC-side connector.

When the push section 66 is further rotated from the position shown in FIG. 13B to the position shown in FIG. 13C, the first contact arm 61 and the second contact arm 65 are elastically deformed. Therefore, the end of the FPC 11 is held and fixed, without being soldered, between the first contact section 61*a* and the second contact section 65*a* with the elastic restoring force uniformly generated in the first contact arm 61 and the second contact arm 65, i.e., forces F2 in FIG. 13C. The end of the FPC 11 is fixed at the center of the FPC insertion slot 23 as shown in detail in FIG. 14.

In this state, each FPC holding section 34 is connected to the corresponding first signal pattern 14; each FPC holding section 44 is connected to the corresponding second signal pattern 15; and each FPC holding section 54 is connected to the corresponding ground pattern 16.

When the push section 66 is moved over the locking section 62, an operator can recognize a sudden drop of a resistance force against the FPC 11, or, recognize a clicking feeling. With the clicking feeling, the operator can recognize that the FPC 11 is completely inserted and can confirm that the FPC 11 is surely fixed and connected.

Figure 15:
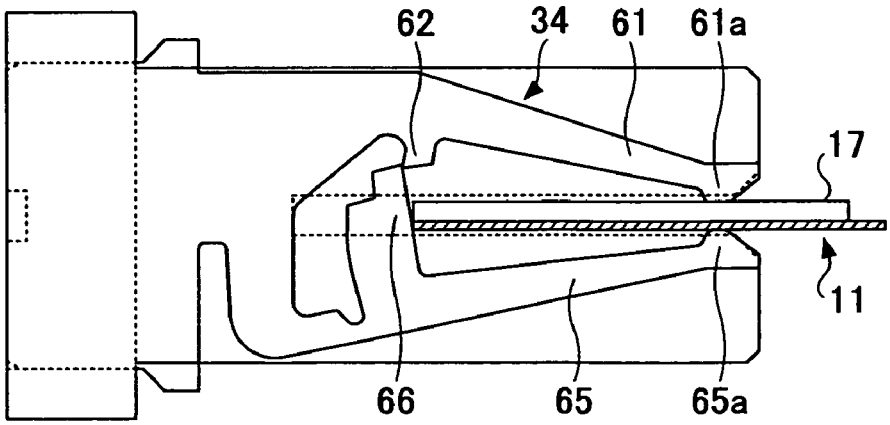
FIG. 15 shows the FPC oriented upside down and connected to the FPC-side connector.

Even when the FPC 11 is inserted upside down, or, with the reinforcing board 17 facing upward as shown in FIG. 15, the FPC 11 is securely fixed by the first contact arms 61 and the second contact arms 65 of the FPC holding sections 34 and 44 and 54. Other than the FPC 11, the connector 20 can securely fix a Flexible Flat Cable (FFC) having a plurality of covered conductors.

Figure 16:
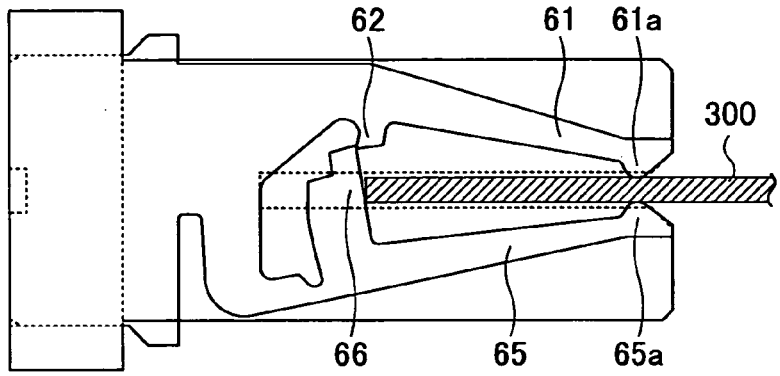
FIG. 16 shows a PCB having a wiring pattern connected to the FPC-side connector.

As shown in FIG. 16, the connector 20 can also be used for fixing a Printed Circuit Board (PCB) 300 on which a parallel wiring pattern is formed. If the PCB 300 is an adapter board, the connector 20 can be used as a cable connector by connecting a coaxial cable, which is a bundle of plural pair wires, to the opposite end of the PCB 300.

Each of the FPC holding sections 34, 44 and 54 may have a vertically (Z1–Z2 direction) inverted configuration so that a Z1-side contact arm has the push section 66 and a Z2-side contact arm has the locking section 62.

Not only the balanced transmission connectors, a contact member having the above-described holding section 34 is applicable to imbalance transmission connectors. In that case, the contact member is simply arranged in an electrical insulating block body.

A FPC holding section according to another embodiment is described below.

Figure 17:
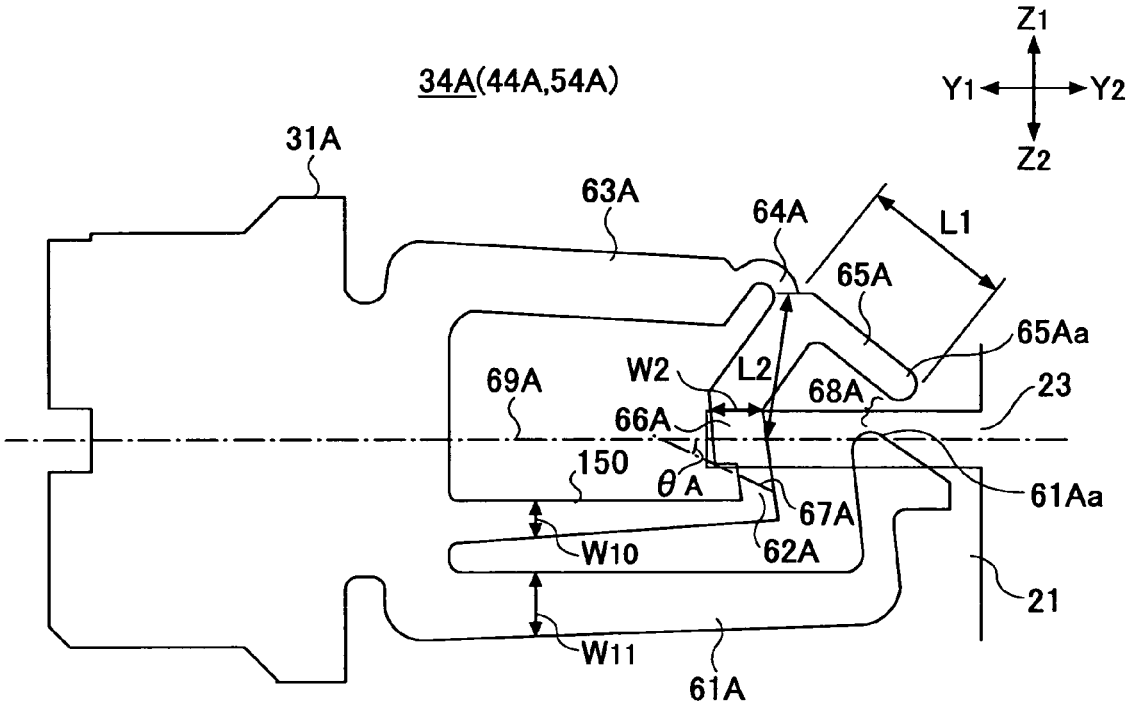
FIG. 17 is an enlarged view of a holding section of a first signal contact member according to another embodiment.

FIG. 17 is an FPC holding section 34A according to another embodiment. The FPC holding section 34A is different from the FPC holding section 34 of FIG. 9 in that an arm dedicated for a locking operation with a width greater than the first contact arm is provided, and that a positional relationship between the first contact arm and the second contact arm in the Z1–Z2 direction is opposite.

As shown in FIG. 17, the FPC holding section 34A comprises a first contact arm 61A extending in the Y2 direction from the Z2-side of a main section 31A, a support arm (arm for a second contact arm) 63A extending in the Y2 direction from the Z1-side of the main section 31A, a locking arm 150 extending in the Y2 direction from the upper Z2-side of the main section 31A, a locking section 62A projecting in the Z1 direction from a front end of the locking arm 150, a narrow section 64A with a semicircular arc shape provided on a front end of the support arm 63A, a second contact arm 65A extending obliquely in the Y2 direction from the narrow section 64A, and a push section 66A extending obliquely downward from a proximal end of the second contact arm 65A toward the locking section 62A. The front end of the locking section 62A abuts the push section 66A. The second contact arm 65A and the push section 66A, substantially forming an L-shape, are configured to move together.

The locking arm 150 is a cantilever arm located between the first contact arm 61A and the support arm 63A and closer to the first contact arm 61A. A width 10 of the locking arm 150 is as narrow as approximately a half of a width 11 of the first contact arm 61A. Therefore, the locking arm 150 can be elastically bent even when a small force in the Z2 direction is applied to the front end thereof.

The push section 66A and the locking section 62A are formed by cutting and dividing a continuous part at a cut 67A with the previously-mentioned pressing method. The cut 67A is inclined by an angle θA relative to a center line 69A, so that the Y1-side of cut 67A is displaced toward the Z2-side relative to the Y2-side thereof.

A triangular first contact section 61Aa at the front end of the first contact arm 61A faces a second contact section 65Aa at the front end of the second contact arm 65A over a clearance 68A.

The FPC holding section 34A and the block body 21 are positioned so that the center line 69A of the FPC holding section 34A is aligned with the center of the FPC insertion slot 23. The first contact section 61Aa projects inside the FPC insertion slot 23 from the Z2-side.

The following describes how the end of the FPC 11 is held by the FPC holding section 34A and connected and fixed to the rear side of the block body 21 without being soldered.

As in the embodiment described above, an operator inserts the end of the FPC 11 into the FPC insertion slot 23 in the Y1 direction with use of a tool (if necessary) until the front end of the push section 66A is moved over the locking section 62A to a position shown in FIG. 18C, or, until the operator feels a clicking movement following the steps explained below.

Figure 18A:
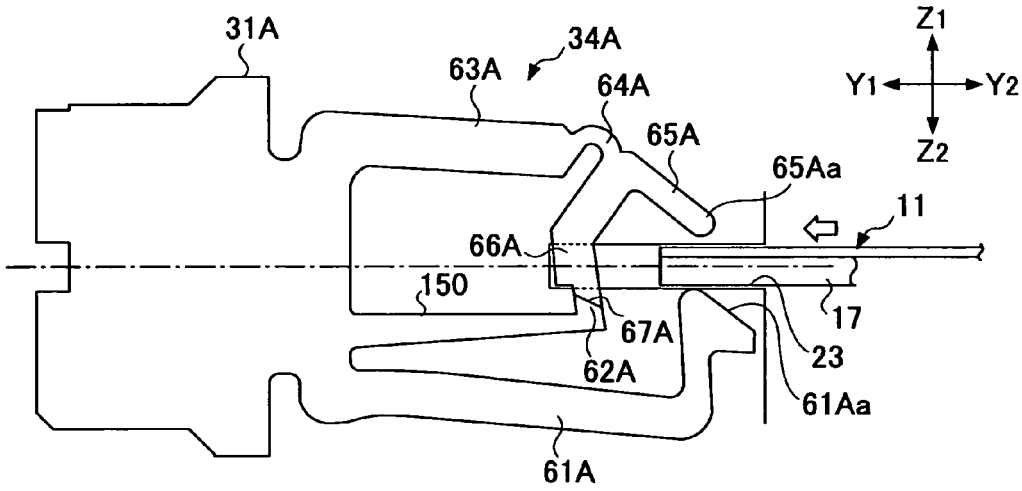
FIGS. 18A through 18C are illustrations showing a process of inserting the FPC into the FPC-side connector and connecting the FPC to the FPC-side connector.

Referring to FIG. 18A, the first contact section 61Aa is moved in the Z2 direction by the reinforcing board 17. At the same time, the first contact arm 61A is elastically moved in the Z2 direction.

Figure 18B:
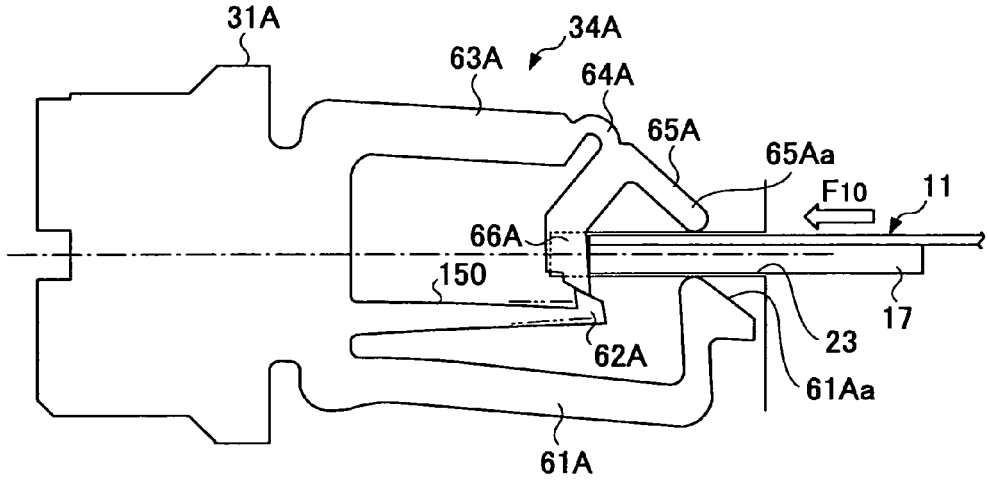
Figure 18C:
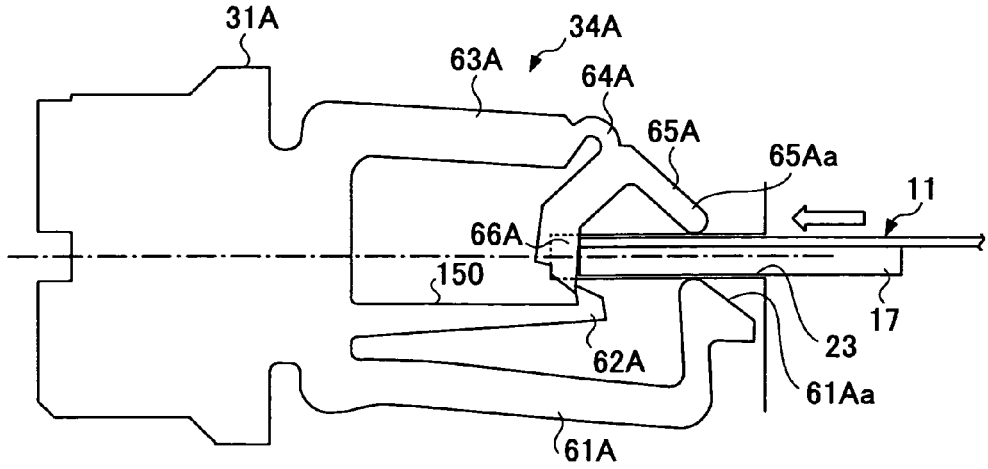
Figure 19A:
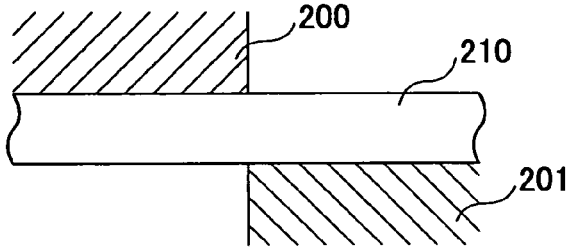
FIGS. 19A through 19D are illustrations showing a pressing process.
Figure 19B:
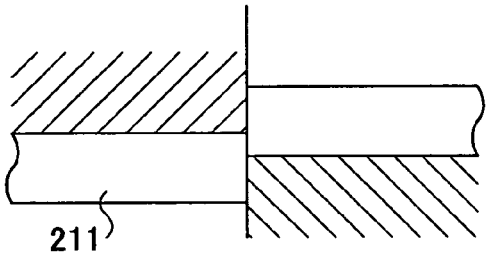
Figure 19C:
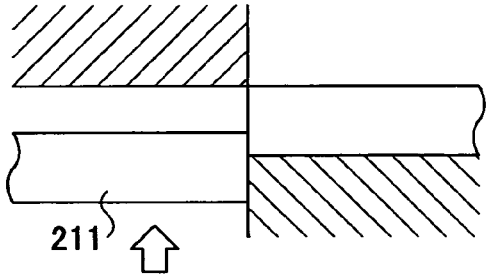
Figure 19D:
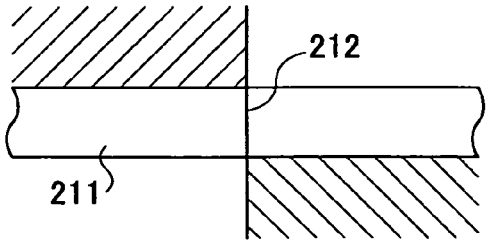

Then, as shown in FIG. 18B, the front end of the FPC 11 pushes the push section 66A in the Y1 direction. The arcuate narrow section 64A is elastically deformed, so that the push section 66A is rotated in the clockwise direction about the arcuate narrow section 64A. The second contact section 65Aa at the front end of the second contact arm 65A is moved in the Z2 direction. When the FPC 11 is inserted to a final position as shown in FIG. 18C, the front end of the push section 66A is moved over the locking section 62A to the Y1-side. The locking section 62A restored with the restoring force inhibits the front end of the push section 66A from moving in the Y2 direction. The FPC 11 is held tightly by the first contact section 61Aa and the second contact section 65Aa. The second contact section 65Aa is positioned above the first contact section 61Aa through the FPC 11.

When the push section 66A is pushed in the Y1 direction by the front end of the FPC 11, the front end of the push section 66A pushes the locking section 62A in the Z2 direction and moves over the locking section 62A to draw a part of a circle having its center on the narrow section 64A. Since the locking section 62A is provided on the locking arm 150 that is elastically moved with a small force, the locking section 62A can be pushed in the Z2 direction with a force smaller than a force required in the case of the FPC holding section 34 of FIG. 9. Therefore, a force F10 for inserting the FPC 11 into the final position is smaller than a force required in the case of the FPC holding section 34 of FIG. 9.

Since the narrow section 64A has a semicircular arc shape and the semicircular arc is deformed when the push section 66A is pushed and moved in the Y1 direction, the push section 66A is smoothly rotated about the narrow section 64A in the clockwise direction.

The second contact arm 65A is shorter than that of the FPC holding section 34 of FIG. 9. The relation of a length L1 (FIG. 17) of the second contact arm 65A and a length from a proximal end of the push section 66A to a distal point of the push section 66A pushed by the FPC 11 is approximately 1:1. Accordingly, a force having the same magnitude as the force applied to the push section 66A by the front end of the FPC 11 is generated in the second contact section 65Aa at the front end of the second contact arm 65A. The force F10 for inserting the FPC 11 to the final position can therefore be reduced.

The FPC holding sections 44A and 54A can be configured in the same way as the above-described FPC holding section 34A.

If the above-described FPC holding section 34A is applied to the FPC-side connector 20 of FIG. 1, the FPC 11 can be more easily connected to the FPC-side connector 20.

The present application is based on Japanese Priority Application No. 2004-239760 filed on Aug. 19, 2004, and Japanese Priority Application No. 2004-264238 filed on Sep. 10, 2004, with the Japanese Patent Office, the entire contents of which are hereby incorporated by reference.

What is claimed is:

1. A contact member for a flat wiring member, comprising:

a main section;

a first contact arm extending from the main section;

a second contact arm extending from the main section to face the first contact arm;

a push section arranged to be pushed by a front end of the flat wiring member inserted between the first contact arm and the second contact arm;

a locking section configured to lock the push section at a position to which the push section is pushed and displaced; and a third contact section extending from the main section in a direction opposite to the first and second contact arms;

wherein when the push section is pushed by the front end of the flat wiring member inserted between the first contact arm and the second contact arm, either the first contact arm or the second contact arm is displaced to narrow a clearance between a first contact section at a front end of the first contact arm and a second contact arm at a front end of the second contact section so that the flat wiring member is held between the first contact section and the second contact section, and the push section is locked by the locking section.

2. A contact member for a flat wiring member, comprising:

a main section;

a first contact arm extending from the main section;

a base arm extending from the main section;

a flexible arm extension provided at a front end of the base arm;

a second contact arm extending from the arm extension to face the first contact arm;

a push section extending from a proximal end of the second contact arm toward the first contact arm and arranged to be pushed by a front end of the flat wiring member inserted between the first contact arm and the second contact arm;

a locking section extending from a proximal end of the first contact arm toward the second contact arm and configured to lock the push section at a position to which the push section is pushed and displaced; and third contact section extending from the main section in a direction opposite to the first and second contact arms;

wherein when the push section is pushed by the front end of the flat wiring member inserted between the first contact arm and the second contact arm, the second contact arm is rotated about the arm extension to narrow a clearance between a first contact section at a front end of the first contact arm and a second contact section at a front end of the second contact arm so that the flat wiring member is held between the first contact section and the second contact section, and the push section is locked by the locking section.

3. A contact member for a flat wiring member, comprising:

a main section;

a first contact arm extending from the main section;

a support arm extending from the main section;

a locking arm extending from the main body section between the first contact arm and the support arm and having a width smaller than a width of the first contact arm;

a flexible arm extension provided at a front end of the support arm;

a second contact arm extending from the arm extension to face the first contact arm;

a push section extending from a proximal end of the second contact arm toward the first contact arm and arranged to be pushed by a front end of the flat wiring member inserted between the first contact arm and the second contact arm;

a locking section arranged at a front end of the locking arm and configured to lock the push section at a position to which the push section is pushed and displaced; and a third contact section extending from the main section in a direction opposite to the first and second contact arms;

wherein when the push section is pushed by the front end of the flat wiring member inserted between the first contact arm and the second contact arm, the second contact arm is rotated about the arm extension to narrow a clearance between a first contact section at a front end of the first contact arm and a second contact section at a front end of the second contact arm so that the flat wiring member is held between the first contact section and the second contact section, and the push section is locked by the locking section.

4. The contact member for a flat wiring member as claimed in claim 1, wherein the push section and the locking section are formed by cutting and dividing a continuous part so that respective cut faces abut each other.

5. The contact member for a flat wiring member as claimed in claim 2, wherein the push section and the locking section are formed by cutting and dividing a continuous part so that respective cut faces abut each other.

6. The contact member for a flat wiring member as claimed in claim 3, wherein the push section and the locking section are formed by cutting and dividing a continuous part so that respective cut faces abut each other.

7. A connector for a flat wiring member, comprising:

an electrical insulating block body; and a plurality of contact members each identical to the contact member of claim 1 arranged inside the block body so that each said third contact sections is positioned at a front side of the block body while the first and second contact arms are positioned at a rear side of the block body.

8. A connector for a flat wiring member, comprising:

an electrical insulating block body; and a plurality of contact members each identical to the contact member of claim 2 arranged inside the block body so that each said third contact sections is positioned at a front side of the block body while the first and second contact arms are positioned at a rear side of the block body.

9. A connector for a flat wiring member, comprising:

an electrical insulating block body; and a plurality of contact members each identical to the contact member of claim 3 arranged inside the block body so that each said third contact sections is positioned at a front side of the block body while the first and second contact arms are positioned at a rear side of the block body.

10. A connector for a flat wiring member, comprising:

a plurality of contact members each identical to the contact member of claim 1, said contact members including signal contact members with the third contact section thereof serving as a signal contact section and ground contact members with the third contact section thereof serving as a ground contact section; and an electrical insulating block body having the signal contact members and the ground contact members arranged therein;

wherein the signal contact members and the ground contact members are arranged inside the block body such that the signal contact section and the ground contact section are positioned at a front side of the block body while the first and second contact arms are positioned at a rear side of the block body, the signal contact members are arranged in pairs, and the paired signal contact members are alternately arranged with respect to the ground contact members.

11. A connector for a flat wiring member, comprising:

a plurality of contact members each identical to the contact member of claim 2, said contact members including signal contact members with the third contact section thereof serving as a signal contact section and ground contact members with the third contact section thereof serving as a ground contact section; and an electrical insulating block body having the signal contact members and the ground contact members arranged therein;

wherein the signal contact members and the ground contact members are arranged inside the block body such that the signal contact section and the ground contact section are positioned at a front side of the block body while the first and second contact arms are positioned at a rear side of the block body, the signal contact members are arranged in pairs, and the paired signal contact members are alternately arranged with respect to the ground contact members.

12. A connector for a flat wiring member, comprising:

a plurality of contact members each identical to the contact member of claim 3, said contact members including signal contact members with the third contact section thereof serving as a signal contact section and ground contact members with the third contact section thereof serving as a ground contact section; and an electrical insulating block body having the signal contact members and the ground contact members arranged therein;

wherein the signal contact members and the ground contact members are arranged inside the block body such that the signal contact section and the ground contact section are positioned at a front side of the block body while the first and second contact arms are positioned at a rear side of the block body, the signal contact members are arranged in pairs, and the paired signal contact members are alternately arranged with respect to the ground contact members.

13. A connector unit, comprising:

the connector for a flat wiring member of claim 7; and the flat wiring member;

wherein an end of the flat wiring member is held and fixed between the first contact section of the front end of the first contact arm of each one of the contact members of the connector and the corresponding second contact section of the front end of the second contact arm.

14. A connector unit, comprising:

the connector for a flat wiring member of claim 8; and the flat wiring member;

wherein an end of the flat wiring member is held and fixed between the first contact section of the front end of the first contact arm of each one of the contact members of the connector and the corresponding second contact section of the front end of the second contact arm.

15. A connector unit, comprising:

the connector for a flat wiring member of claim 9; and the flat wiring member;

wherein an end of the flat wiring member is held and fixed between the first contact section of the front end of the first contact arm of each one of the contact members of the connector and the corresponding second contact section of the front end of the second contact arm.

16. A connector unit, comprising:

the connector for a flat wiring member of claim 10; and the flat wiring member;

wherein an end of the flat wiring member is held and fixed between first contact section of the front end of the first contact arm of each one of the contact members of the connector and the corresponding second contact section of the front end of the second contact arm.

17. A connector unit, comprising:

the connector for a flat wiring member of claim 11; and the flat wiring member;

wherein an end of the flat wiring member is held and fixed between first contact section of the front end of the first contact arm of each one of the contact members of the connector and the corresponding second contact section of the front end of the second contact arm.

18. A connector unit, comprising:

the connector for a flat wiring member of claim 12; and the flat wiring member;

wherein an end of the flat wiring member is held and fixed between first contact section of the front end of the first contact arm of each one of the contact members of the connector and the corresponding second contact section of the front end of the second contact arm.

* * * * *

UNITED STATES PATENT AND TRADEMARK OFFICE

CERTIFICATE OF CORRECTION

PATENT NO. : 7,004,775 B1
APPLICATION NO. : 11/095576
DATED : February 28, 2006
INVENTOR(S) : Atsushi Sakurai et al.

It is certified that error appears in the above-identified patent and that said Letters Patent is hereby corrected as shown below:

Column 10, Line 17, insert -- a -- before "third".

Signed and Sealed this

First Day of August, 2006

JON W. DUDAS
*Director of the United States Patent and Trademark Office*